US006036272A

United States Patent [19]

Samples et al.

[11] Patent Number: 6,036,272

[45] Date of Patent: Mar. 14, 2000

[54] SUPPORT FOR CHAIRS AND METHOD OF MANUFACTURING

[75] Inventors: John Wayne Samples, Afton; Steven A. Buono, Greeneville, both of Tenn.

[73] Assignee: Meco Corporation, Greeneville, Tenn.

[21] Appl. No.: 08/888,568

[22] Filed: Jul. 7, 1997

[51] Int. Cl.[7] ..... A47C 7/00

[52] U.S. Cl. ..... 297/452.55; 297/452.31; 297/452.59; 411/111

[58] Field of Search ..... 297/452.48, 452.55, 297/452.6, 452.59, 452.31, 452.3; 403/343; 411/111, 112, 133

[56] References Cited

U.S. PATENT DOCUMENTS

| | | | |
|---|---|---|---|
| 2,833,339 | 5/1958 | Liljengren . | |
| 2,899,689 | 8/1959 | Pastl . | |
| 2,960,152 | 11/1960 | Wendel | 297/452.48 |
| 3,026,145 | 3/1962 | Galbraith | 297/452.55 |
| 3,081,077 | 3/1963 | Sudman . | |
| 3,103,082 | 9/1963 | Baermann | 297/452.48 |
| 3,127,201 | 3/1964 | Granlund | 297/452.6 |
| 3,807,800 | 4/1974 | Morrison et al. | 297/452.6 |
| 3,851,920 | 12/1974 | Harris et al. | 297/452.55 |
| 3,961,823 | 6/1976 | Caudill, Jr. . | |
| 4,065,182 | 12/1977 | Braniff et al. . | |
| 4,711,496 | 12/1987 | Lathers et al. . | |
| 5,121,963 | 6/1992 | Kwasnik et al. . | |
| 5,409,323 | 4/1995 | Greene | 297/452.55 |
| 5,704,691 | 1/1998 | Olson | 297/452.55 |

*Primary Examiner*—Anthony D. Barfield
*Attorney, Agent, or Firm*—Roberts Abokhair & Mardula LLC

[57] ABSTRACT

A substrate for chairs formed from a resilient material with molded locator pin(s) to facilitate assembly. The substrate comprises a friction seat and a curled back portion around its perimeter. The friction seat, in conjunction with the curled back surface, afford an improved surface for adhering padding and upholstery thereto. Integrally molded on the back surface of the substrate are locator pin(s) having bracing members molded throughout the circumference thereof. The locator pin(s) further comprise pre-drilled holes defined as conduits. Mounted on the front surface of the substrate are semi-spherical projections having pre-drilled holes. The pre-drilled holes of the semi-spherical projections and the conduits are axially aligned. Fastening means communicate within the conduits and the pre-drilled holes of the semi-spherical projections, thus mounting the substrate to a chair. The semi-spherical projections prevent the fastening means from advancing past the front surface of the substrate, thus obstructing the fastening means from harming the chair's occupant. The semi-spherical projections and locator pin(s) are fixedly mounted to the contoured shaped member, thereby retaining their positions during assembly.

20 Claims, 7 Drawing Sheets

SUPPORT FOR CHAIRS AND METHOD OF MANUFACTURING

FIELD OF INVENTION

The present invention relates generally to a padded chair member and method of assembly. More particularly, the present invention relates to a padded chair member which is easy to assemble into a furnished chair, simple in its construction, and includes padded members that are affixed to a chair for the added comfort and support of the chair's occupant, as well as a method of manufacturing the completed chairs.

BACKGROUND AND DESCRIPTION OF RELATED ART

Folding chairs and other components of chairs have been manufactured for decades. Normally, the manufacturer prefabricates the chair's components and assembles these to form a functional chair. Many such chairs have back supports and other surfaces of chairs which are covered with padding and material that is fastened to the chair surface for added support. Normally the padding and material are mounted onto a contoured molded press board which, in turn, is attached to the front surface of the chair. Unfortunately, existing methods of chair construction—with padded members and contoured shapes—are difficult and time consuming to assemble, add to the cost of the finished product, and as important, lead to an excess amount of product waste.

For example, a back support member of a chair will usually be constructed from molded press board and have a concave surface (facing the front) and a general rectangular shape. On the reverse side of the molded press board are several openings that accommodate clamps. These clamps are basically U-shaped with legs extending perpendicular from the ends and screw holes placed therein. The clamps are placed in openings of the press board so that the legs of the clamps are resting on the front surface. A padded cushion is set over the legs of the clamps and a material is then fastened over the padding. Screws are then secured through the surface of the chair into the clamps so as to secure the padded member to the chair surface.

Since the padding is not fastened to the press board it has a tendency to move during construction and become clumped. A further shortcoming of this technique is that the screws placed in the clamps have a tendency to protrude from the front surface of the press board and prick the seated person, as well as eventually shred the material backing. Additionally, it is very common for the U-shaped clamps to tear the material backing when the assembler applies pressure to the screw during assembly of the chair component to the chair surface. It is also time consuming, and in most instances, difficult to locate the U-shaped clamp for proper screw placement and precise location of the chair component to the chair itself—since the clamp has a tendency to shift during manufacture and assembly.

Several inventors have attempted to devise methods for the construction of padded chairs. To this extent, U.S. Pat. No. 2,833,339 to C. P. Liljengren discloses a seat construction adapted for use in vehicles, such as automobiles and aircraft. The seat cushion consists of an underlying support structure and a covering pad which serves to trim and finish the cushion member and perform incidental cushioning functions. The underlying supporting structure provides a yieldable body-contour forming support. Connected to the underlying supporting structure is a beam element which constitutes the rigid support for the seat bottom. Side members are attached to the beam element and a cross bar by spike like projections placed therein, or in the alternative, a closure plate member is socketed or tapped to receive a bolt or screw.

Similarly, U.S. Pat. No. 4,065,185 to Braniff et al. discloses a cushioned vehicle seat, and more particularly, improved retention of a resilient foam cushion bun and a seat cover on a molded plastic seat support. The seat bottom support and back support are molded from plastic and cooperate by a pocket that receives a pivot arm which is mounted on the back support. Integrated into the bottom support are abutment tabs which have a downwardly opening transversely extending slot. A seat cover is then sewn together with an opening in the underside to accommodate a seat bun. A retainer wire further retains the seat bun in the seat cover and extends around the edge portion of the seat cover which is connected to J-shaped extruded plastic strips. The J-shaped strips fit into the abutment tabs thereby securing the seat covering and bun to the bottom support. The abutments on the back seat support include a pair of truncated conical projections which project forward from the seat back support and are attached by self tapping screws. To further secure the back cushioned member to the back support, a flap portion comprising a plastic cover and a plurality of snap-in-fasteners are attached to the seat cover. The snap-in-fasteners are engaged in a plurality of mating holes provided in the surface of the back support.

A vehicle seat with a bolster wire assembly for attaching a seat cover to a vehicle seat is disclosed in U.S. Pat. No. 3,961,823 to Caudill, Jr. ('823). Patent '832 comprises a vehicle seat having a bottom and a back. The bottom includes a molded foam cushion which has a slot therein. The foam cushion is covered by fabric which extends inwardly in the slot and is sewn together forming an end, which is thereafter sewn to a conventional fabric list forming a list wire. The list wire is anchored to the foam cushion by a bolster wire assembly which is embedded in the foam mold prior to the foaming of the cushion. The bolster wire assembly is located at the bottom of the slot and extends beyond the side walls. The list wires are attached to hog rings which are installed to encircle the wires at spaced intervals.

U.S. Pat. No. 4,711,496 to Lathers et al. ('496) discloses yet another vehicle seat, and more specifically, the construction of a vehicle seat which provides a built-in occupant restraint system. The '496 patent discloses a back plate assembly constructed from a hardened material which includes an outer and inner back shell. Between the inner and outer shells is a flexible spider assembly with legs extending outward. The legs are bridged over the inner seat back to form a cushion. In an alternate embodiment, a foam padded member is added above the folded legs to provide a seat contact. A padded cushion may also be attached to a seat portion of the vehicle seat.

Additionally, U.S. Pat. No. 3,081,077 to C. F. Sudman discloses a seat construction consisting of a frame formed by front, end, and rear rails, as well as a sponge rubber seat cushion molded to a series of flexible strips. The flexible strips are attached to the front and rear rails and are provided with openings so that the rubber can extend therethrough during the molding process thereby forming an interlock between the rubber and itself To embed the strips in the sponge rubber a mold comprising a bottom section and a top section is desired. The uncured sponge rubber is placed in the lower portion of the bottom section and the flexible strips are mounted to the upper portion of the bottom section with spring clips holding the flexible strips in place. The top part of the mold is placed into position and the sponge rubber is expanded and vulcanized until it engages the flexible strips and extends through the openings.

U.S. Pat. No. 2,899,689 to A. J. Pastl discloses a cushioned toilet seat. The base of the toilet seat is formed from a molded plastic or other resilient material. The upper face of the base consists of grooves which extend outward and inward from the edges. The base is further provided with openings for communicating the grooves with a passage that extends rearward along the bottom side of the base for travel of air therethrough. Fixedly attached to the upper face of the base is a cushioning member formed from foam rubber and enclosed with a shell that is impervious to fluid and sanitary material. The grooves formed in the upper face of the base serve as air conduits for displaced air. As a separate function, the grooves further provide recesses in the communication with the underside of the cushioning member to enable displacement of portions of the cushioning when air flow is not available.

Lastly, U.S. Pat. No. 5,121,963 to Kwasnik et al. relates to an armrest storage assembly having means for retaining upholstered material about a vehicle seat assembly and a vehicle armrest. A U-shaped channel is disposed around the perimeter of the lower and upper portions of the armrest assembly. The U-shaped channel includes lateral walls and a bottom surface which is composed of several apertures therethrough. Placed within the U-shaped channel and further covering the apertures is a foam padding and a cover, both of which are also disposed about the entire armrest assembly. A U-shaped retainer ring consisting of pointed distal end pins engage the apertures, thereby restraining the padding and cover within the U-shaped channel. The U-shaped retainer rings further include an outside wall having a gripping means defined by a plurality of triangular downwardly extending barbs which grip the foam padding and cover when the retainer ring is forcibly inserted into the U-shaped channel. A coacting means having a hook, recess, front locking wall, and bottom locking surface, locks the retainer ring into the channel.

All of the above references use padding, coverings, and retention means (to secure the padding and covering) in a fashion that does not allow for easy and rapid manufacture and assembly of chairs, as well as furnish a comfortable chair at an inexpensive price. Further, the above references do not alleviate the possibility that the chair's upholstery may tear due to the retention means, e.g., screws and clamps, piercing through the chair components during manufacture and usage, thus damaging the upholstery—and possibly harming the occupant. Additionally, current methods of construction do not facilitate easy assembly of the chair's components, as well as provide a secure platform for the padding and upholstery to adhere to so as not bunch and clump during assembly thereof A further shortcoming of current chair construction is the inability to cater to varying seating schemes, to wit automobiles, airplanes, folding chairs, etc. Lastly, current chair construction does not teach the construction of varying chair components, such as backs, seats, and armrests, utilizing an inexpensive, simple, and uniform construction for all components.

What is needed to overcome the shortcomings of existing chairs and the construction thereof is a durable padded support member that allows for easy assembly and manufacture, as well as the comfort and safety of a person seated thereon. Such a support member would include a resilient member that is able to withstand external loads, yet be supple enough to contour to the seated persons' body contours. The chair would be constructed so that the upholstery and padding that is to be fitted to the chair would not clump or bunch during construction. The construction of the support member would also include a fastening mechanism that would further affix the upholstery and padding to the support member without the possibility of the upholstery and padding tearing and eventually harming the occupant of the seat. Lastly, a fixed locator device for the alignment of the support member to the chair surface is needed. This locator device would further provide additional material so that the fastening means can "bite" into the support member and securely fix it to the chair. This locator device will not fall off or be able to be pushed back into the padding of the support member during construction of the chair.

SUMMARY OF THE INVENTION

It is therefore an object of the present invention to provide a chair support that is easily assembled into a finished chair.

It is an object of the present invention to provide a chair support that inhibits padding and upholstery attached thereto from moving during assembly of the finished chair.

It is a further object of the present invention to provide a padded and upholstered chair support that is affixed to a chair which does not clump or bunch when an occupant is seated thereon.

It is still a further object of the present invention to provide a chair support which includes a mounting mechanism that prevents a fastening means from tearing the upholstery and padding during construction and use thereof It is yet a further object of the present invention to provide a chair support which is comfortable for the occupant and prevents the occupant from being harmed from a fastening means that protrudes through the seat padding.

It is still yet a further object of the present invention to provide a chair support that can be fixed to any portion of any chair quickly and accurately with little or no rework.

It is another object of the present invention to provide a chair that eliminates parts that can fall or be punched out the back side of a chair.

It is still another object of the present invention to provide a chair support that is manufactured at a low cost.

These and other objects and advantages of the present invention will be apparent to those of ordinary skill in the art upon inspection of the detailed description, drawings, and appended claims.

The support for chairs and its related method of manufacturing, (the "present invention") is contemplated for use in all chairs and components thereof A representative sample of these chairs include reclining chairs, folding chairs, automobile and airline seats, rocking chairs, etc. The present invention will also be utilized for a wide variety of purposes such as lumbar and head support. The present invention will also allow for easy assembly so that a chair's occupant can adjust the support to other chairs or chair components for his comfort and enjoyment. The present invention will also facilitate easy construction and assembly during the manufacturing process. Thus, the present invention is a multi-use support for chairs that is easily assembled and designed to be used in a variety of different circumstances and for a variety of different chair components—depending on the intent of the individual. The multi-use nature of the present invention also affords the user several options that were not previously available—i.e., using the same support on different chairs depending on the objectives of the individual user.

The present invention utilizes a plastic (or other resilient material) contoured support member or substrate that is attached to any surface of any chair. In addition to the contoured shape, the edges of the plastic member are slightly curled back providing more surface area. Integrated on the convex side of the contoured support member are molded locator pins that have pre-formed conduits which accommodate screws and facilitate the rapid placement and attachment of the contoured support member to the front surface of the chair. The locator pins further add material to the support member so that the screws or other fastening means can "bite" into the material.

Aligned with the pre-formed conduits of the locator pins are molded semi-spherical projections that extend outward from the concave surface of the plastic support member. These projections have pre-drilled holes and accommodate the ends of screws or other fastening devices and, as such, do not permit the screws or other fastening devices to extend beyond the projections themselves. As such, the screws or other fasteners cannot project past the surface of the support member and shred the material backing during construction or prick the chair's occupant. The locator pins and semi-spherical projections provide a fixed surface that does not move during assembly and manufacture of the chair.

Fashioned into the perimeter of the support member is preferably a grid that serves as a friction seat, although other textured patterns will serve the same purpose. The friction seat, in conjunction with the curled surface, securely affixes the padding to the contoured support member's surface, thereby keeping it from bunching or clumping during assembly of the finished chair or over time as a person sits on the chair.

DETAILED DESCRIPTION OF THE INVENTION

The present invention is directed towards a support or substrate for chairs and method of manufacturing thereof, designed for easy manufacturing and assembly. The present invention also adds comfort and support to the chair's occupant. The dimensions of the substrate, including length, width, contour, thickness, and other characteristics and quantities specified herein may vary with the type of substrate contemplated for use with the present invention. Therefore, numbers and dimensions specified herein are not to be construed as limitations on the scope of the present invention but are meant to be merely illustrative of one particular application. For example, it is contemplated that the length and thickness of the substrate may vary in different applications so as to accommodate any number of combinations of chairs and chair components.

Further, the detailed description of the present invention is also based on a method of manufacturing the support for chairs utilizing the present invention as specified herein. Therefore, methods specified herein are not to be construed as limitations on the scope of the present invention but are meant to be merely illustrative of one particular application. For example, it is contemplated that locator pins be located on various locations on the support for chairs for easy assembly.

The present invention is a padded support member designed to attach to various chairs and chair components. Alternate embodiments of the present invention do not have to be fixed to a chair and may be designed for portable use. A user may thereby transfer the substrate from one application to another or from one chair to another chair easily. Thus, the present invention affords the user several different adaptations and is able to be used by several individuals without modification. The following applications and usages of the substrate are but some illustrations of the present invention:

(i) lumbar support for chairs;

(ii) headrest for chairs, (iii) armrest for chairs; and (iv) other applications can be used on various chairs such as, automobile, aircraft, boat, as well as reclining and folding chairs, etc.

It is obvious to one skilled in the art of the present invention that alternate embodiments of the present invention can include several variations of the above, such as other chair and chair component variants.

The substrate of the present invention is a molded plastic or other similar structural material that provides a resilient and yieldable body-contour forming chair support member. It is preferred that a hardened resin plastic be used in the present invention. The shape of the present invention will vary in accordance with its numerous applications as previously illustrated.

Figure 1:
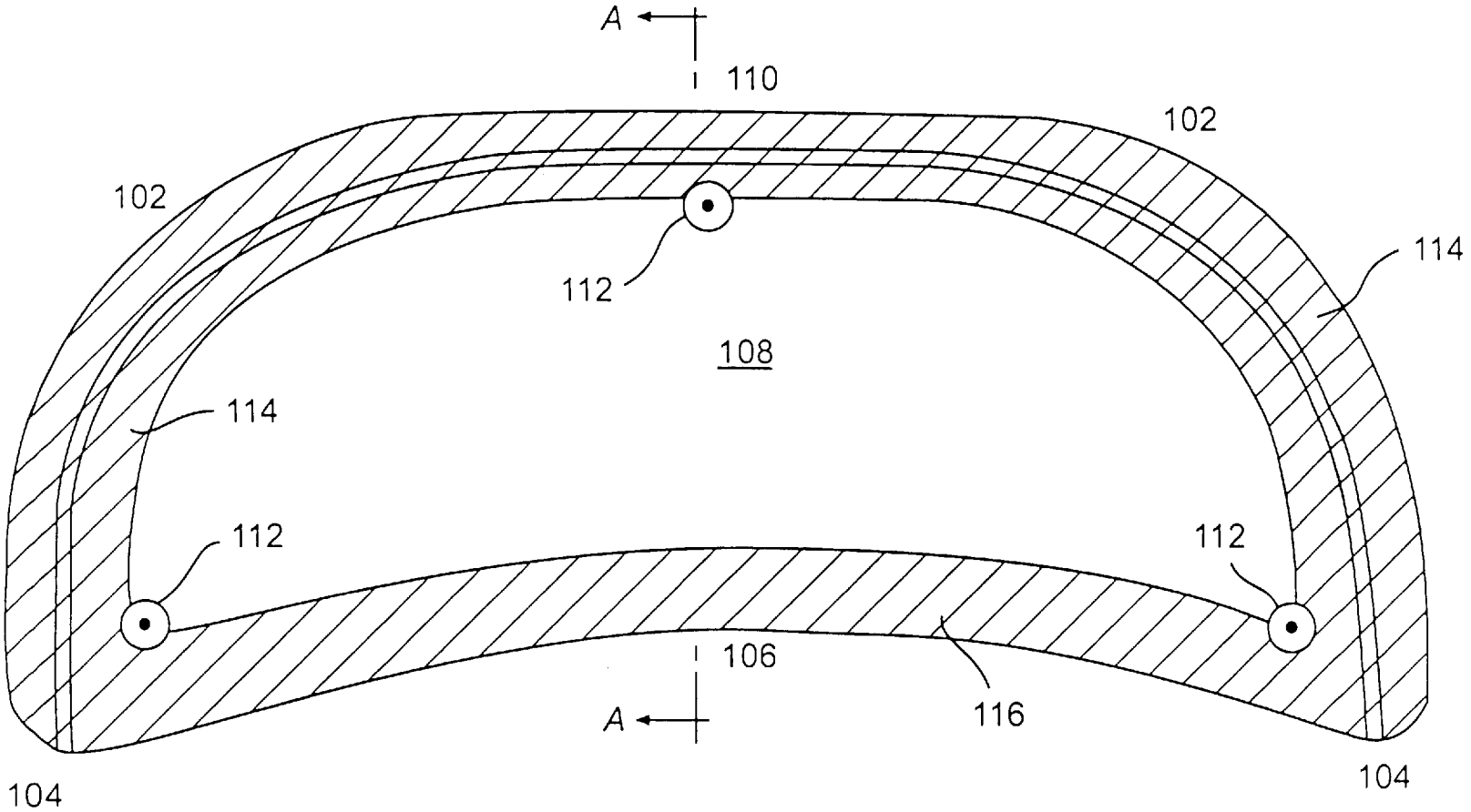
FIG. 1 depicts a front view of the substrate.

Referring to FIG. 1, a front view of the substrate is illustrated. The substrate has a concave surface (facing the front) and a general rectangular shape. Upper corners 102 of the substrate are rounded and extend downward to lower corners 104. Lower corners 104 of the substrate are positioned slightly lower than lower portion 106. Lower corners 104 further protrude slightly outward from the remainder of the substrate, and most notably with respect to lower portion 106. Due to the shape of the substrate, middle portion 108 is slightly recessed relative to the remainder of the substrate. Upper portion 110 sits in a substantially parallel plane with upper corners 102. Throughout the back surface of the substrate are locator pins 112 Locator pins 112 communicate with screws or other fastening means, such as nails, bolts, or the like, and allow for the rapid and easy assembly of the chair. Locator pins 112 also provide additional material so that the screws or other fastening means can "bite" into the material and thereby be securely fixed to the chair surface. Additionally, locator pins 112 act as a guide for the precise placement of the screws or other fastening means as well as provide accurate placement of the substrate to the appropriate chair surface. Molded into the perimeter of the substrate is a grid or other textured pattern that serves as friction seat 114 which affords an improved surface to prevent material movement and to assist with the adhesion of the padding to the substrate.

Figure 2:
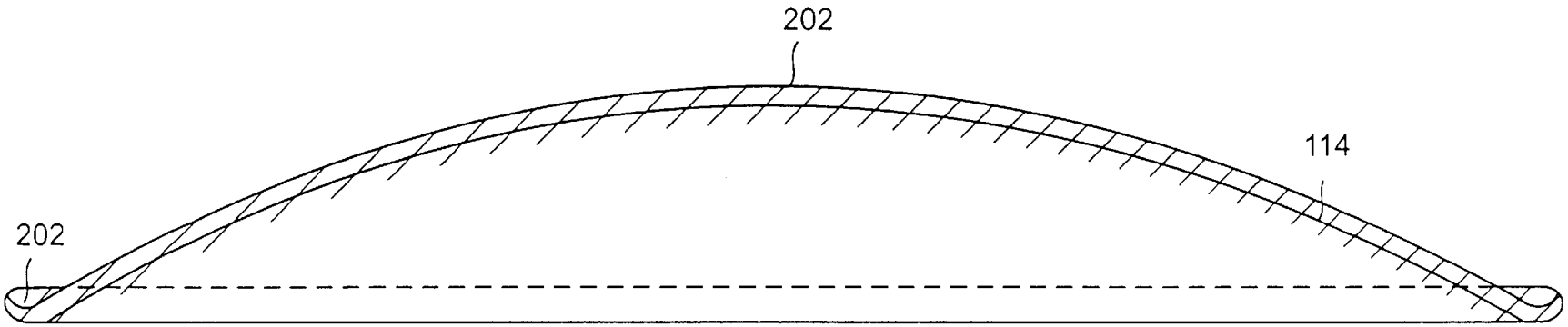
FIG. 2 depicts a substrate having a curled back portion.

FIG. 2 depicts a substrate having a curled back portion. Molded curled back portion 202 provides additional surface area for adhering a padding to the substrate. Molded curled back portion 202 also retains the padding in its preferred position during construction thereof Friction seat 114 also aids molded curled back portion 202 in retaining the padding in its preferred position during construction thereof Preferably, friction seat 114 comprises grooves which extend outward and inward from the edges of the substrate, thereby forming a checkerboard pattern. In an alternative embodiment, friction seat 114 may be designed using ridges, or any regular or random pattern and formed in any section of the substrate. Friction seat 114, in conjunction with molded curled back portion 202, securely holds the padding to the chair surface and keeps it from slipping out of place during construction or use by the chair's occupant. In this manner the padding will not clump, bunch, or add any discomfort to the chair's occupant. Alternate embodiments of the present invention utilizing substantially the same elements, such as armrests, headrests, seat bottoms, etc., are contemplated as being within the scope of the present invention.

Figure 3:
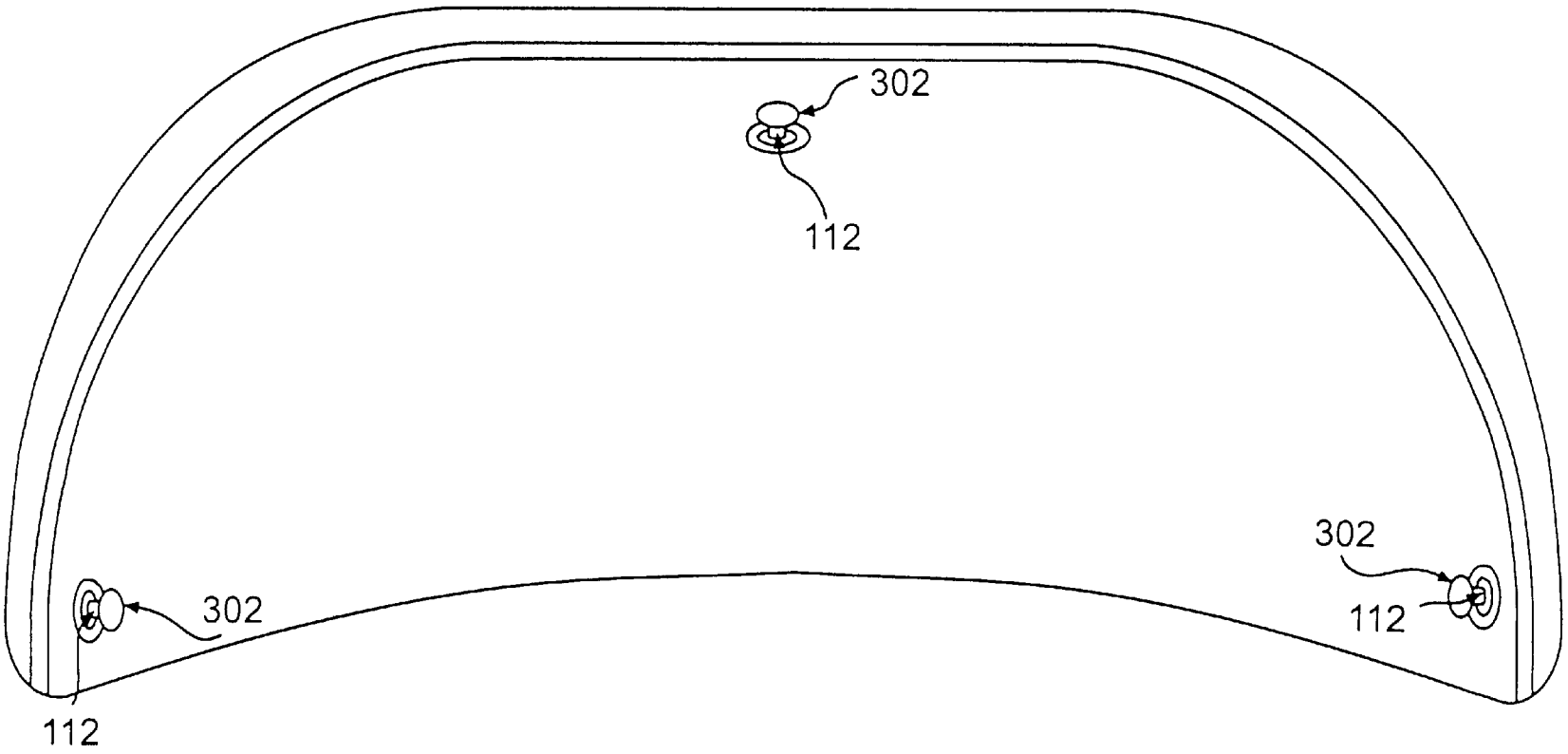
FIG. 3 depicts a rear view of the substrate.

FIG. 3 depicts a rear view of the substrate. Integrated on the back surface of the substrate are molded locator pins 112 which include conduit 306 that accommodates screws or other fastening means. Molded locator pins 112 also facilitate the rapid placement and attachment of the substrate to the front surface of a chair. Locator pins 112 further act as guides for the precise placement of the screws or other fastening means, as well as for the accurate placement of the substrate onto the chair's surface.

Aligned with conduit 306 of locator pin(s) 112 are molded semi-spherical projections 302 that extend outward from the front surface of the substrate. Semi-spherical projections 302 include pre-drilled holes and accommodate the ends of the screws or other fastening means such that the screws or other fastening means are not permitted to extend beyond semi-spherical projections 302. Thus semi-spherical projections 302 prevent the screws or other fastening means from advancing beyond the front surface of the substrate and pricking the seated person or shredding the material backing. Semi-spherical projections 302 and locator pins 112 are fixedly attached to the substrate, and will not be displaced in any manner during the construction and assembly of the substrate or finished chair. In a preferred embodiment, the semi-spherical projections 302 and locator pins 112 are molded into the substrate.

Fixedly mounted to the radial sides of locator pins 112 and the back side of the substrate are bracing members 304. Bracing members 304 add further strength and stability to locator pin(s) 112 and the substrate. It is preferred that three bracing members 304 be located equidistant from one another around the circumference of locator pin(s) 112. It will be appreciated by those skilled in the art that bracing members 304 may be spaced at other intervals and quantities around the circumference of locator pin(s) 112. It is also seen from the preferred embodiment that locator pin(s) 112 are substantially perpendicular to the back of the substrate.

Figure 4:
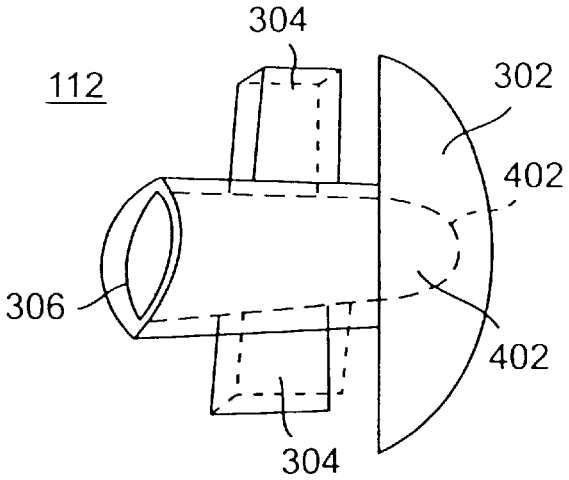
FIG. 4 depicts an enlargement of a locator pin and semi-spherical projection.

FIG. 4 depicts an enlargement of locator pin 112 showing conduit 306, semi-spherical projection 302 and bracing members 304. Semi-spherical projection 302 is connected to and aligned with locator pin 112. Conduit 306 is axially aligned with pre-drilled hole 402 of semi-spherical projection 302. Pre-drilled hole 402 of semi-spherical projection 302 is preferably located in the center thereof; however, pre-drilled hole 402 can be positioned at any angle and at any location on semi-spherical projection 302. It is obvious to one skilled in the art that conduit 306 and locator pin(s) 112 can also be repositioned when the angle or location of pre-drilled hole 402 in semi-spherical projection 302 are relocated to other areas on semi-spherical projection 302. To this end, locator pin(s) 112 may not always be substantially perpendicular to the back of the substrate.

Figure 5:
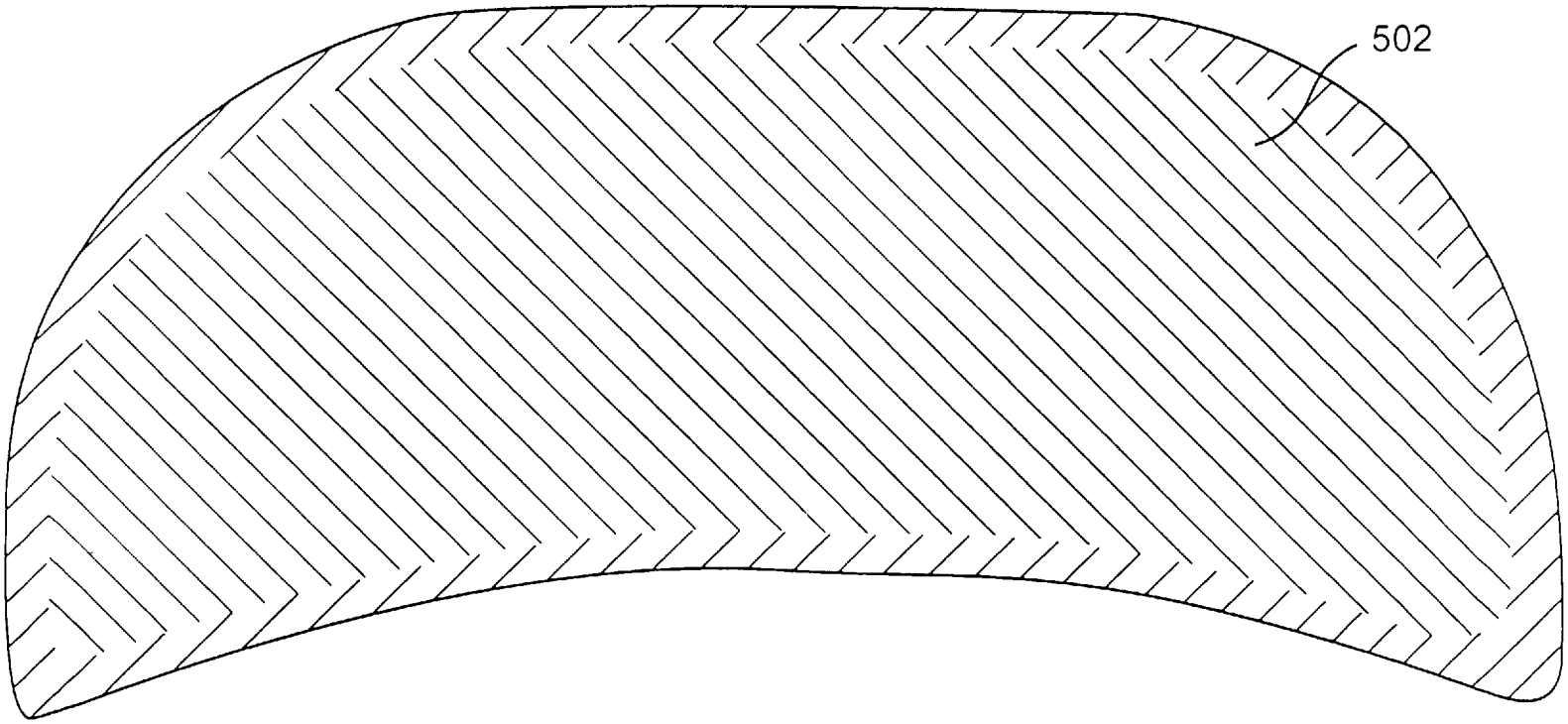
FIG. 5 depicts a padded cushion.

FIG. 5 depicts padded cushion 502 which is set over the substrate and is secured thereto by a material covering or other fastening means. Padded cushion 502 is preferably a foam cushion or other comparable material. Padded cushion 502 is substantially the same size as the substrate. Padded cushion 502 lays over semi-spherical projection(s) 302, but does not interfere with the rapid placement and attachment of the substrate to the front surface of a chair. It is further noted that semi-spherical projection(s) 302 does not interfere with padded cushion 502. Semi-spherical projection 302 is fixedly mounted to the substrate and padded cushion 502 sits flat against the same.

Figure 6:
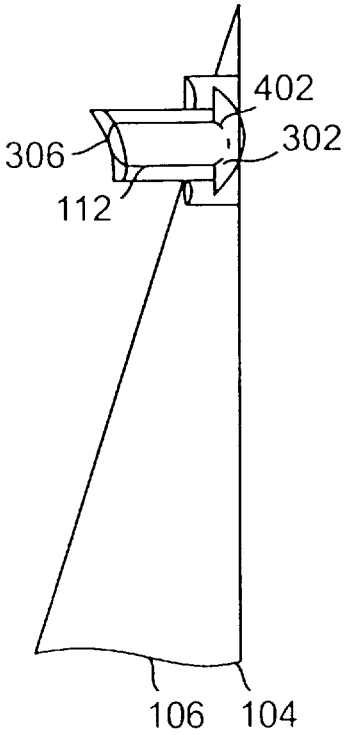
FIG. 6 depicts a cross sectional view of the substrate substantially along line A—A of front view of FIG. 1.

FIG. 6 shows a cross sectional view of the substrate taken substantially along line A—A of FIG. 1. As shown, FIG. 6 depicts locator pin(s) 112 mounted on the back side of the substrate. Lower portion 106 of the substrate is slightly recessed in relation to lower corners 104. Locator pin(s) 112 have conduit 306 substantially within the center thereof Conduit 306 receives screws or other fastening devices, thereby securing the substrate to a chair. The diameter of conduit 306 will vary depending on the diameter of the screw or other fastening means. Conduit 306 is aligned with pre-drilled hole 402 of semi-spherical projection 302.

Figure 7:
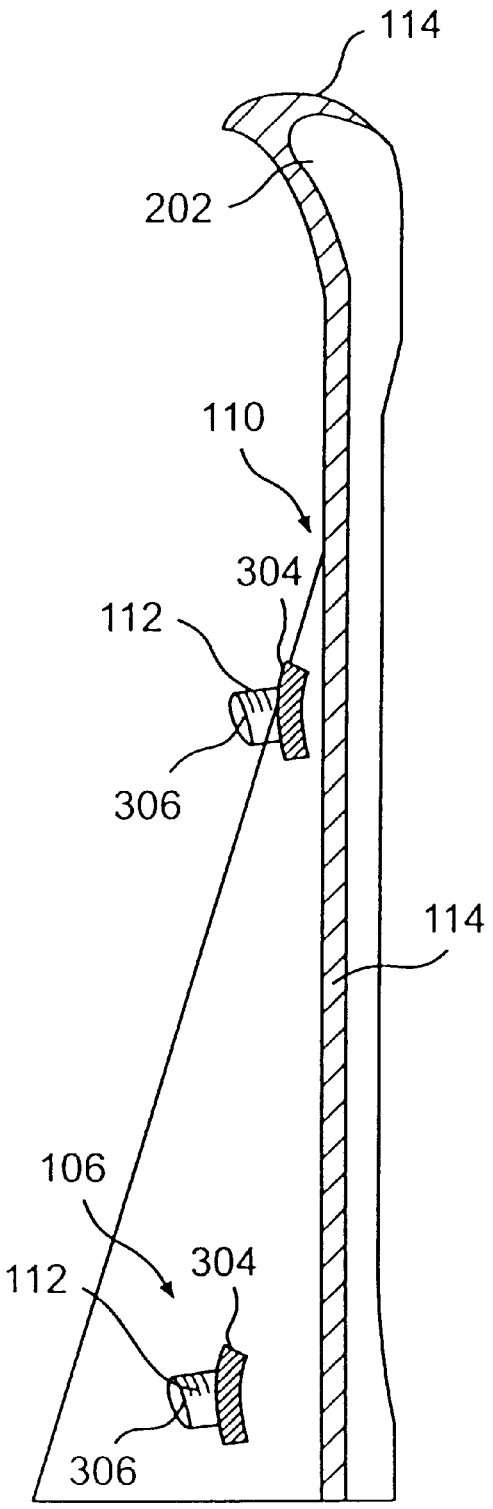
FIG. 7 depicts a side view of the padded support member.

Referring to FIG. 7 a side view of the substrate is shown. As seen in this view, curled back portion 202 and friction seat 114 are located generally around the perimeter of the substrate. Friction seat 114 preferably comprises grooves which extend outward and inward from the edges forming a checkerboard pattern. The pattern of friction seat 114 and curled back portion 202 securely holds the padding to the substrate during construction and use thereof. Other variants of friction seat 114, such as parallel lines, diamond shaped grooves, and other patterns of differing lengths, contours, and groove depth are envisioned.

As further seen from FIG. 7, locator pin(s) 112 and conduit(s) 306 are substantially perpendicular to the back of the substrate Attached to the radial portion of locator pin(s) 112 are bracing members 304. Locator pin(s) 112 are preferably located on upper portion 110 and lower portion 106 of the substrate. The locations of locator pin(s) 112 are also envisioned in other locations, and may be located on any portion of the substrate's back surface for the rapid and facile placement of screws or other fastening means and the substrate to a chair surface.

Figure 8:
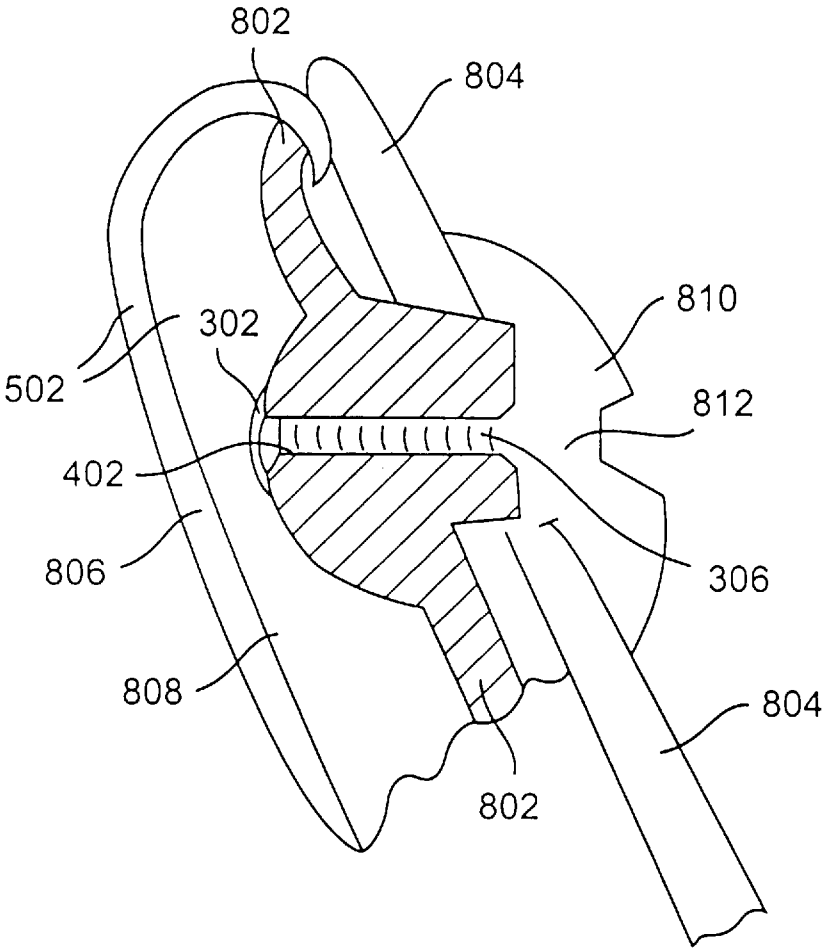
FIG. 8 depicts an assembled combination of substrate, chair back and padded cushion.

FIG. 8 depicts a portion of an assembled combination of substrate 802, chair back 804, and padded cushion 502. As depicted, padded cushion 502 comprises cover material 806 which overlays foam cushion 808. This combination is placed abreast, over and partially behind substrate 802. Chair back 804 is connected to substrate 802 with fastening means 810. Fastening means 810 is inserted through pre-drilled opening 812 in chair back 804, it travels through conduit 306, into pre-drilled hole 402 and is stopped by semi-spherical projection 302. In this manner, substrate 802 is quickly and accurately attached to chair back 804.

Other support members or substrates utilized for different chair components having various shapes and sizes are further envisioned. For example an alternate embodiment of the present invention can be used as an arm rest. In this instance, the substrate will be a substantially elongated rectangle with rounded corners. Throughout the armrest will be locator pin(s) with conduits and a friction seat. The perimeter of the armrest may be slightly curled back to afford more surface area, and in conjunction with the friction seat, form an improved surface which securely retains the padded cushion thereto during manufacture and use thereof On the front surface of the armrest will be semi-circular projections aligned with the conduits of the locator pin(s) so as to accommodate screws or other fastening means. The conduits of the locator pin(s) will be axially aligned with the pre-drilled holes of the semi-spherical projections. The semi-spherical projections will prevent the advancement of the fastening means from penetrating the front surface of the armrest and will protect the chair's occupant from being pricked when seated thereon.

In order to properly and effectively facilitate the attachment of the substrate to the surface of a chair, an assembler will communicate a screw or other fastening device between the chair surface and locator pin(s) 112 of the substrate. More specifically, the assembler will simply:

1. Attach foam cushion 808 and cover material 806 to substrate 802,

2. Align conduit(s) 306 of locator pin(s) 112 with corresponding pre-drilled opening(s) 812 located on the chair back 804;

3. Place fastening means 810 through conduit 306 until fastening means 810 communicates with corresponding conduit 306, and 4. Secure fastening means 810 through conduit 306 so that substrate 802 and chair back 804 are tightly coupled.

During this process locator pin(s) 112 and semi-spherical projections 302 remain fixed on substrate 802, with semi-spherical projection 302 preventing fastening means 810 from damaging padded cushion 502 or injuring an occupant.

Preferred and alternate embodiments of the present invention have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons skilled in the art.

What is claimed is:

1. A padded support member for chairs, comprising:

(a) a substrate having a front surface, back surface, and a perimeters;

(b) a plurality of locator pin(s) extending from the back surfaces of the substrate, the plurality of locator pins having holes there through defined as conduits, wherein the substrate and plurality of locator pin(s) are formed in a single molded piece; and (c) a plurality of semi-spherical projections mounted on the front surface of the substrate, the plurality of semi-spherical projections having a pre-drilled hole, the hole being axially aligned and communicating with the conduits, wherein said projections are separate from said locating pin(s).

2. A padded support member for chairs as in claim 1, further comprising a texture friction seat integrally molded on the front surface of the substrate.

3. A padded support member for chairs as in claim 1, further comprising a curled back section placed substantially around the perimeter of the front surface of the substrate.

4. A padded support member for chairs as in claim 2, wherein the friction seat is further positioned around the perimeter of the substrate.

5. A padded support member for chairs as in claim 2, wherein the friction seat is formed from a series of grooves.

6. A padded support member for chairs as in claim 2, wherein the friction seat is formed from a series of ridges.

7. A padded support member for chairs as in claim 1, wherein the locator pin(s) further comprise bracing members radially disposed about the circumference of the locator pin(s) and fixed to the back surface of the substrate.

8. A padded support member for chairs as in claim 1, wherein the substrate is formed from a resilient molded material.

9. A padded support member for chairs as in claim 1, further comprising a padded cushion, the padded cushion being substantially the same size and shape as the substrate and placed over the front surface of the substrate.

10. A padded support member for chairs as in claim 7, further comprising a means for fastening the padded cushion to the front surface of the substrate.

11. A padded support member for chairs, comprising:

(a) a contoured shaped support member having a front surface, a back surface, a perimeter, a lower portion, an upper portion, and corners;

(b) a plurality of locator pin(s) mounted directly on the rear surface of the contoured shaped support member, the plurality of locator pin(s) having holes therethrough defining conduits; and (c) a plurality of semi-spherical projections mounted on the front surface of the contoured shaped support member, the plurality of semi-spherical projections having pre-drilled holes, the holes being axially aligned with and communicating with the conduits, wherein said projections are separate from said locating pin(s).

12. A padded support member for chairs as in claim 11, further comprising a tertured friction seat integrally molded on the front surface of the contoured shaped support member.

13. A padded support member for chairs as in claim 12, wherein the friction seat is further integrally molded around the perimeter of the contoured shaped member.

14. A padded support member for chairs as in claim 11 further comprising a curled back section integrally molded on the front surface of the contoured shaped support member.

15. A padded support member for chairs as in claim 14, wherein the curled back section is further integrally molded around the perimeter of the contoured shaped support member.

16. A padded support member for chairs as in claim 11, wherein the plurality of locator pin(s) further comprise bracing members, the bracing members being radially disposed around the plurality of locator pin(s) and being further affixed to the back surface of the contoured shaped support member.

17. A padded support member for chairs as in claim 11, further comprising a padded cushion, the cushion padding being placed over the front surface of the contoured shaped support member.

18. A padded support member, comprising:

(a) a substrate having a front surface, a back surface, a perimeter, a lower portion, an upper portion, and corners;

(b) a plurality of locator pin(s) mounted directly on the rear surface of the substrate, the plurality of locator pin(s) having holes therethrough defined as conduits;

(c) a plurality of semi-spherical projections mounted on the front surface of the substrate, the plurality of semi-spherical projections having pre-drilled holes, the holes being axially aligned and communicating with the conduits, wherein said projections are separate from said locating pin(s);

(d) a textured friction seat integrally molded around the perimeter of the front surface of the substrate;

(e) a curled back section integrally molded around the perimeter of the front surface of the substrate; and (f) a padded cushion placed over the front surface of the substrate.

19. A padded support member as in claim 18, wherein the friction seat is integrally molded on the front surface and around the perimeter of the substrate.

20. A padded support member as in claim 18, further attached to the back surface of the substrate.

* * * * *